US005501213A

United States Patent [19]

Jackson

[11] Patent Number: 5,501,213

[45] Date of Patent: Mar. 26, 1996

[54] GAS FLOW CONTROL VALVES

[75] Inventor: Peter J. Jackson, Findon, England

[73] Assignee: Racal Health & Safety Limited, England

[21] Appl. No.: 309,992

[22] Filed: Sep. 20, 1994

[30] Foreign Application Priority Data

Sep. 22, 1993 [GB] United Kingdom ..... 9319580

[51] Int. Cl.[6] ..... A62B 9/02

[52] U.S. Cl. ..... 128/205.24; 128/204.26

[58] Field of Search ..... 128/204.26, 205.24, 128/202.24, 204.18, 207.16; 137/513.7, DIG. 9, 494, 908

[56] References Cited

U.S. PATENT DOCUMENTS

| | | | |
|---|---|---|---|
| 3,647,175 | 3/1972 | Bonneau et al. | 251/61 |
| 4,224,938 | 9/1980 | Hilal | 128/204 |
| 4,345,592 | 8/1982 | Giorgini et al. | 128/204 |
| 4,345,593 | 8/1982 | Sullivan | 128/204 |
| 4,361,145 | 11/1982 | Ekstrom et al. | 128/204 |
| 4,572,176 | 2/1986 | Walther | 128/204 |
| 4,693,242 | 9/1987 | Biard | 128/204 |
| 4,715,371 | 12/1987 | Haas | 128/204 |
| 5,190,030 | 3/1993 | Semeia | 128/204.26 |

FOREIGN PATENT DOCUMENTS

| | | |
|---|---|---|
| 0047575 | 3/1982 | European Pat. Off. . |
| 0014290 | 6/1983 | European Pat. Off. . |
| 0164505 | 12/1985 | European Pat. Off. . |
| 0260021 | 3/1988 | European Pat. Off. . |
| 2426289 | 12/1979 | France . |
| 389412 | 7/1965 | Germany . |
| 2014047 | 8/1979 | United Kingdom . |
| 1570065 | 6/1980 | United Kingdom . |
| 1569875 | 6/1980 | United Kingdom . |
| 2054207 | 2/1981 | United Kingdom . |
| 2074455 | 11/1981 | United Kingdom . |
| 2085306 | 4/1982 | United Kingdom . |
| 2116852 | 10/1983 | United Kingdom . |
| 2171916 | 9/1986 | United Kingdom . |
| 2178964 | 2/1987 | United Kingdom . |
| 2190001 | 11/1987 | United Kingdom . |

*Primary Examiner*—Edgar S. Burr
*Assistant Examiner*—Eric P. Raciti
*Attorney, Agent, or Firm*—Anna E. Mack; Pedro P. Hernandez

[57] ABSTRACT

A positive pressure demand valve for breathing apparatus incorporates a tubular "balanced piston" valve member for regulating the flow of breathing gas from an inlet to an outlet. A coaxial tension spring acts to bias the valve member open and a lever coupled to a pressure-responsive diaphragm acts to push the valve member closed when a predetermined pressure is attained within the outlet. A combined pressure-relief and bypass valve member enables the operation of the main valve member to be bypassed by porting gas through the center of the main valve seat. A "first breath" mechanism is provided comprising a hooked link which can be pressed in by a button to maintain the main valve member closed and can be released by contact by the diaphragm when a negative pressure is applied to the outlet. The outlet is in the form of a bayonet connector which is locked into a corresponding inlet fitting on the user's mask by means of the same button.

15 Claims, 4 Drawing Sheets

GAS FLOW CONTROL VALVES

BACKGROUND OF THE INVENTION

The present invention relates to gas flow control valves and more particularly to demand valves for breathing apparatus.

In one aspect, the invention is concerned with a valve incorporating a so-called "balanced piston" valve member, which is characterised by low operating forces and an ability to operate consistently over a range of supply pressures. Such a valve for use in underwater diving equipment is described and illustrated schematically in U.S. Pat. No. 3,647,175. It is an aim of the present invention to adapt this principle to use in a positive pressure demand valve of compact construction and efficient operation.

SUMMARY OF THE INVENTION

Accordingly, in this aspect the invention resides in a gas flow control valve which comprises an inlet chamber and an outlet chamber, a movable valve member for controlling the flow of pressurised gas from the inlet chamber to the outlet chamber, and a flexible pressure-responsive member sensitive to the gas pressure within the outlet chamber for controlling the movement of the valve member. The valve member is an axially-slidable member of tubular form, one end of which extends into the inlet chamber, the other end of which leads to the outlet chamber, and the interior of which defines a flow path to lead gas from the inlet chamber to the outlet chamber. A valve seat faces the valve member in the inlet chamber such that the spacing of the valve member from said seat controls the rate of gas flow through the valve member from the inlet chamber to the outlet chamber and contact of the valve member with said seat shuts off such flow. Spring means act upon the valve member to bias the same away from said seat. The axis of flexure of the pressure-responsive member is inclined to the axis of the valve member and mechanical linkage means are provided to link the pressure-responsive member to the valve member. Therefore in use reduction of gas pressure within the outlet chamber causes the pressure-responsive member to flex in one sense and permits the valve member to move away from said seat under the bias of said spring means while increase of gas pressure within the outlet chamber causes the pressure-responsive member to flex in the opposite sense to cause the mechanical linkage means to move the valve member towards said seat against the bias of said spring means.

BRIEF DESCRIPTION OF THE DRAWINGS

The invention will now be more particularly described, by way of example, with reference to the accompanying drawings, in which.

DETAILED DESCRIPTION OF THE PREFERRED EMBODIMENT

Figure 1:
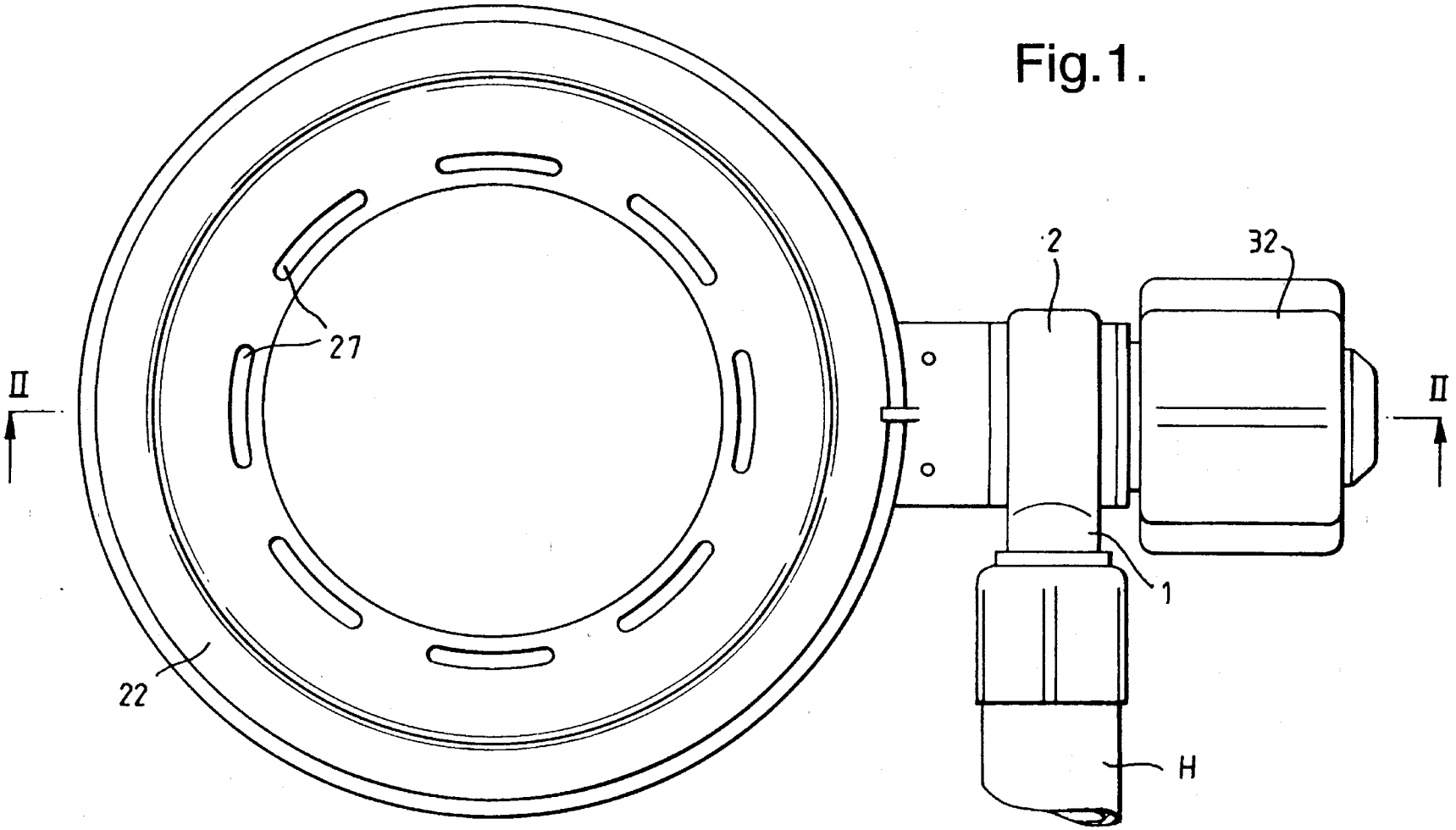
FIG. 1 is a frontal view of a preferred form of positive pressure demand valve in accordance with the invention.
Figure 2:
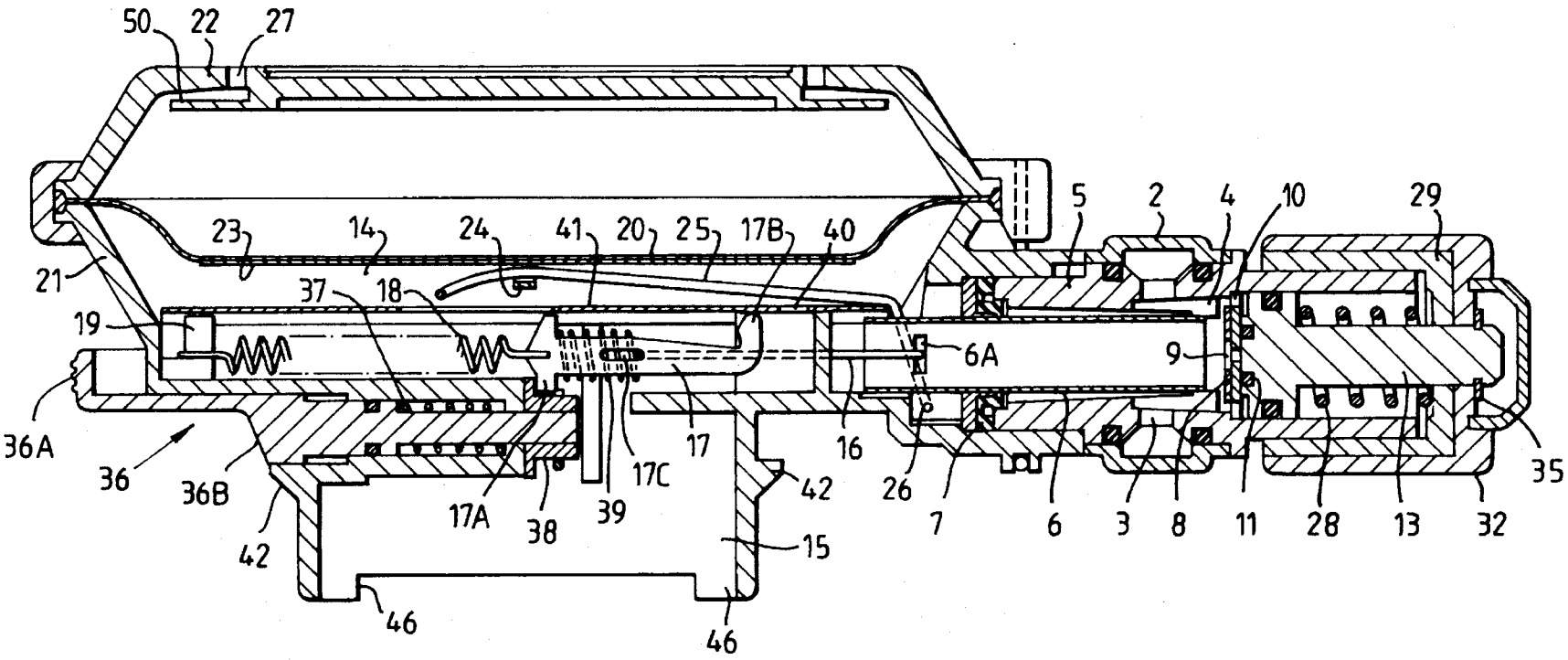
FIG. 2 is a section on the line II—II through the valve of FIG. 1, shown in an open condition.

With reference to the drawings, the illustrated valve is for regulating the flow from a source of compressed air (not shown) into a facemask (not shown) worn by the user, at a variable rate sufficient to meet the breathing demand of the user and so as normally to maintain a specified super-ambient pressure within the facemask throughout the respiratory cycle. In use, a flexible hose H (FIG. 1) from the air source is connected to the inlet spigot 1 of a swivel connector 2 which leads, through radial ports 3 (FIG. 2), into a chamber 4 within a body member 5. A "balanced piston" valve member 6, in the form of a thin-walled tube of e.g. stainless steel, is borne slidably by the body member 5 and sealed thereagainst by a low friction (e.g. energised PTFE) seal 7. One end of the valve member 6 extends into the chamber 4 and there faces a fixed valve seat 8. In the illustrated embodiment there is a port 9 through the centre of the seat 8 and further ports 10 around its periphery, but in normal operation flow between these ports is prevented by a seal 11 carried by the head of a piston 13 the purpose of which will be described hereinafter.

The opposite end of the valve member 6 communicates with a diaphragm chamber 14 and with the outlet 15 of the valve which in use is coupled into the inlet of the user's facemask. That end of the valve member is also mechanically coupled, through a two-armed wire link 16 and a flat, hook-shaped link 17, to one end of a coiled tension spring 18, the other end of which is anchored to a fixed post 19. The assembly of spring 18 and links 16,17 extends diametrally across the chamber 14 and coaxial with the valve member 6, the action of the spring being to bias the valve member in the direction away from its seat 8. In the illustrated unseated condition of the valve member, a flowpath will therefore be formed from chamber 4, through the interior of the valve member 6, into chamber 14 and out through the outlet 15, the rate of flow at any time being determined by the spacing of the end of the valve member from its seat 8 and of course being shut off in the event that the valve member is moved into contact with the seat.

Figure 3:
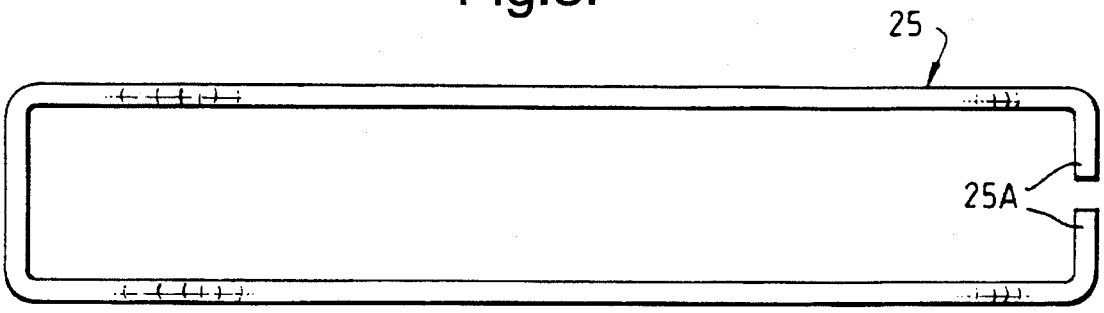
FIG. 3 is a plan view, to an enlarged scale, of the diaphragm lever used in the valve of FIGS. 1 and 2.
Figure 4:
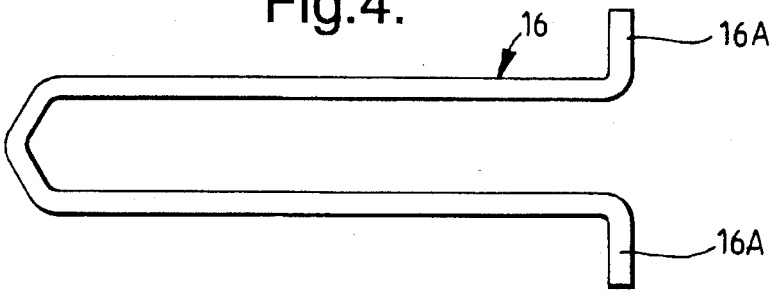
FIG. 4 is a plan view, to an enlarged scale, of a valve link used in the valve of FIGS. 1 and 2

Bounding the side of chamber 14 opposite to the outlet 15 is a flexible diaphragm 20 of e.g. silicone rubber. This diaphragm is clamped peripherally between housing members 21 and 22 of the valve structure and its central, flat portion is bonded to a rigid plate 23. The plate 23 carries a bridge piece 24 by which is trapped one end of a two-armed wire lever 25. The opposite ends of the lever's arms are turned in (as shown at 25A in FIG. 3) and pivoted where indicated at 26 in the housing member 21, with the lever straddling the valve member 6. The ends of the two arms of the wire link 16 are turned out (as shown at 16A in FIG. 4) to pass through slots 6A in the wall of the valve member and abut the straddling arms of the lever 25. The action of the spring 18 in withdrawing the valve member from its seat 8 is therefore also to pivot the lever 25 anticlockwise (as viewed in FIG. 2) and bias the diaphragm 20 inwards with respect to the chamber 14.

It will be appreciated that in use of the illustrated valve the inner side of the diaphragm 20 is exposed to the air pressure within chamber 14 (which is substantially the same as in the user's facemask) while the outer side of the diaphragm is exposed to ambient pressure (for which purpose the housing member 22 is ventilated with a ring of slots 27). The diaphragm will accordingly flex inwardly and outwardly in accordance with variations in the pressure differential across it. That is say, a reduction in the pressure within chamber 14 consequent upon inhalation of the user will draw the diaphragm 20 inwards allowing the valve member 6 to open (or open further) under the bias of spring 18 and supply air to the user in accordance with his breathing demand. Conversely, at the end of inhalation and during exhalation the pressure within chamber 14 will rise, therefore flexing the diaphragm 20 outwardly and pivoting the lever 25 clockwise (as viewed in FIG. 2) so that the valve member is pushed towards its seat 8 and reduces the rate of flow through the valve (or eventually shuts off). At all times, however, the system is biased towards an open position by the spring 18 to ensure that a specified minimum super-ambient pressure is maintained within the chamber 14 and facemask throughout the entire breathing cycle, thereby ensuring that any leakage between the facemask and the external atmosphere can only be in the outward direction.

As usual, the facemask will be equipped with a separate one-way exhalation valve (set at a higher opening pressure than the closing pressure of the demand valve) through which the user's exhalate is vented and which ensures that a fresh supply of air is provided by the demand valve to the user upon each inhalation.

Advantages of the "balanced piston" valve arrangement described herein are that only small forces are required in order to open and close the valve member 6 and that it can operate consistently despite variations in the supply pressure. In particular when the valve is closed there is no force imparted by the supply pressure in chamber 4 acting to open it. Biasing of the system is accomplished by the single spring 18 in contrast to the conventional practice with "positive pressure" demand valves where there is one spring applied to the valve member in the closing direction (to counter the force of the supply pressure) plus a separate biasing spring applied to the diaphragm in the valve-opening direction.

Further features of the illustrated valve will now be described.

Firstly, it is desirable that the user of a demand valve has the option of bypassing the operation of the usual automatic control means in the event of some failure in the latter which results in an insufficient rate of flow being supplied by the valve or of the valve member even becoming stuck in its closed position. It is also desirable, particularly in the case of the illustrated valve where the supply pressure has no tendency to unseat the valve member 6, that means are provided for venting excess pressure in the event that an abnormally high supply pressure is experienced which might otherwise lead to a danger of bursting the supply hose H. In the illustrated valve the latter function is accomplished by the piston 13 to which the supply pressure is communicated from the chamber 4 by ports 10 around the valve seat 8. A strong spring 28 compressed between this piston and a sleeve 29 on the end of the body member 5 normally keeps the piston in its illustrated closed position against the "reverse" side of the seat 8. If the supplied pressure force exceeds the spring force on the piston 13, however, it will be displaced from the seat 8 and open a flow path from the ports 10 around the reverse side of the seat 8 and through its central port 9, thereby venting the excess pressure through the main valve into the facemask (and thence to atmosphere through the exhalation valve or around the face seal).

Figure 5:
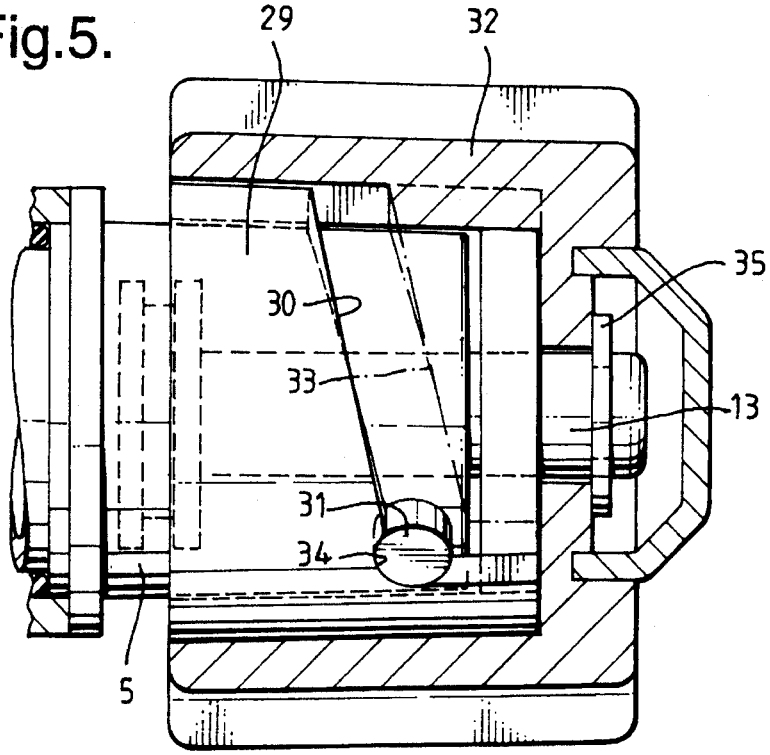
FIG. 5 is a part sectional view, to an enlarged scale, of part of the bypass valve incorporated in the valve of FIGS. 1 and 2.

The same piston 13 can be displaced manually by the user to supply air continuously through the port 9, and thereby bypass the operation of the diaphragm 23, lever 25 and valve member 6 if necessary. For this purpose, and with reference to FIG. 5, the sleeve 29 is formed at two diametrically opposite positions with cam surfaces 30 each engageable with a respective peg 31 on the fixed body member 5. A knob 32 is keyed to the sleeve 29 for turning the same and is formed internally with cam surfaces 33 facing the surfaces 30 so as collectively to define a pair of helical slots. In the closed position of the bypass as illustrated in the Figures the rotational position of the sleeve 29 on the body member 5 is defined by detent recesses 34 adjacent to the cam surfaces 30 engaging the pegs 31, the sleeve being urged against the pegs 31 in this position by the action of the spring 28. A quarter anti-clockwise turn of the knob 32, however, causes the sleeve 29 to turn likewise with the helical slots defined between faces 30/33 running over the pegs 31 so that the sleeve and knob are also displaced axially away from the body member 5 by a distance determined by the pitch of those slots. In so doing the knob 32 engages a retainer 35 on the end of the piston 13 to withdraw the piston from the seat 8 and open the bypass flowpath.

Another desirable feature of a positive pressure demand valve is a so-called "first breath" mechanism. To explain, it is frequently the case that the user of a breathing apparatus, after donning the apparatus, turning on the gas supply and checking the operation of the apparatus, has to stand by for a period before entering the hazardous zone in which respiratory protection is required. For personal comfort and to avoid unnecessary depletion of the gas source it is usual to doff the facemask during such periods, or disconnect the demand valve from the facemask and breath ambient air through the mask inlet. In either case, since the pressure sensed within the demand valve is now only ambient, its normal reaction is to open fully under its positive pressure bias (i.e. spring 18 in the present example), which would lead to rapid depletion of the gas source if steps are not taken to shut off the flow. It is undesirable on such occasions to shut off the gas supply at source and so it is known to provide a demand valve itself with manually-operable means for closing the valve. It is also known to provide means for automatically releasing the closure of the valve when a specified sub-ambient pressure is applied to its outlet so that as soon as the facemask is donned once more, or the demand valve is reconnected, the first inhalation of the user will create the necessary negative pressure to release the valve and it will automatically revert to its normal positive pressure mode of operation. Such a "first breath" mechanism is incorporated in the illustrated demand valve and will now be described.

That is to say a slide 36, manually-accessible at 36A, is borne in the side of the valve outlet 15 and biased outwards by a compression spring 37. The inner end of the slide 36 carries a flanged button 38 which faces the head 17A of the hook-shaped plate 17 below its connection to the spring 18. A light compression spring 39 is also trapped between the head 17A of the plate and the end of the link 16 coupled to that plate. The effect of pressing in the slide 36, therefore, is to push the plate 17 to the right (as viewed in FIG. 2) and this has the effect of seating the valve member 6, thereby shutting off the flow of gas through the valve. Furthermore as the hooked end 17B of the plate 17 encounters an aperture 40 in a baffle 41 extending across the chamber 14 the plate is allowed to pivot under the force applied to its head from the slide button 38 so that its hooked end enters the aperture 40 and retains the plate in its displaced position, while the slide 36 is free to return to its outward position under the action of spring 37. The valve member 6 therefore remains seated under the force of the spring 39 while it is relieved of the force of the main biasing spring 18. Necessary lost-motion between the plate 17 and link 16 during this action is provided by the slot 17C in the plate. Subsequent generation of a negative pressure within chamber 14 by inhalation of the user when the facemask is donned draws in the diaphragm 20 to its fullest extent so that the diaphragm plate 23 engages the hook 17B and presses it out of the aperture 40, thereby allowing the spring 18 to pull the plate 17 clear of the aperture 40 and resume its positive pressure control of the valve.

Figure 6:
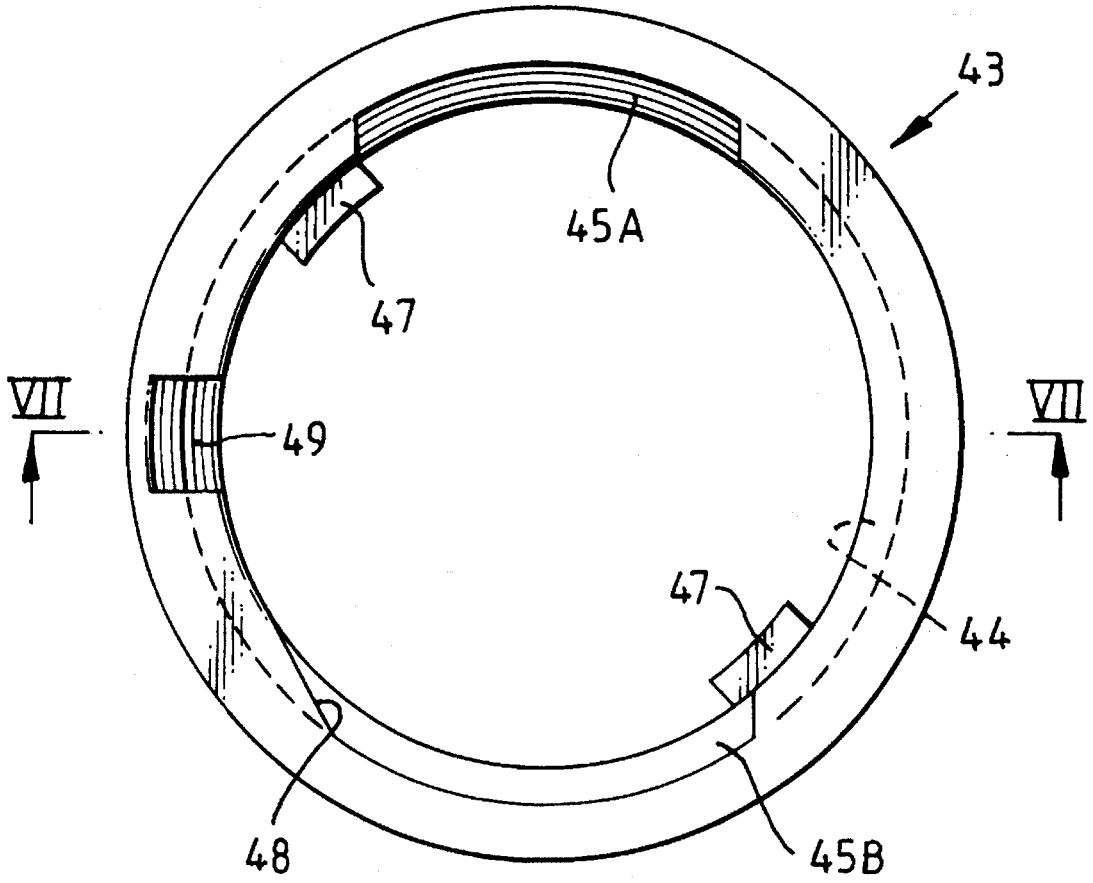
FIG. 6 is a frontal view of a mask socket for coupling with the valve of FIGS. 1 and 2.
Figure 7:
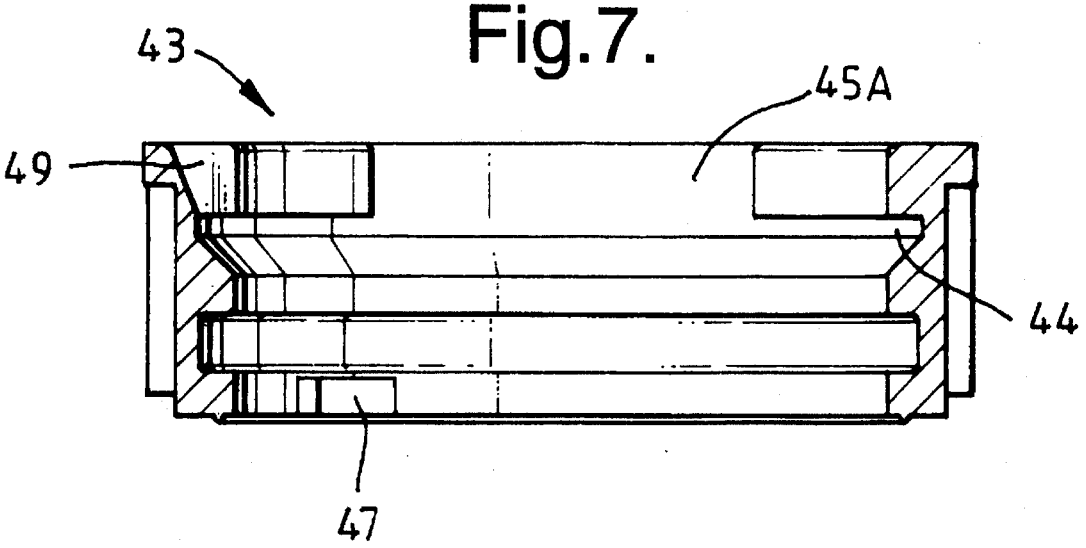
FIG. 7 is a section on the line VII—VII through the socket of FIG. 6.

The slide 36 also serves the function of locking the demand valve into the inlet of the user's facemask. The outlet 15 of the demand valve is formed as a bayonet connector, with a pair of circumferential ledges 42 projecting at two diametrically opposite locations. The corresponding inlet socket 43 of the facemask is shown in FIGS. 6 and 7. It is formed with an internal groove 44 complementary to the ledges 42, this groove being relieved to define slots 45A, 45B at two opposite locations. The valve is coupled to the socket by passing the ledges 42 axially through the slots 45A, 45B and giving the valve a quarter turn to locate the ledges 42 in respective portions of the groove 44. Respective pairs of stops 46, 47 on the valve outlet and socket limit the turning movement of the valve in this respect. The socket slot 45B also has a cam surface 48 which engages the exposed part 36B of the slide 36 to press in the slide as the valve is turned in the socket, the slide subsequently springing out into a detent slot 49 in the side of the socket to prevent return rotation of the valve when it has reached the fully inserted position. To remove the valve from the socket, however, the slide 36 is pressed in manually to free the valve for return rotation.

From the foregoing it will be appreciated that the "first breath" mechanism described above will be automatically set by operation of the slide 36 whenever the demand valve is connected to our disconnected from the socket 43.

Finally, the illustrated demand valve is also configured to alleviate a problem which can arise when operating at low temperatures. A demand valve may typically be required to operate in a range of ambient temperatures down to −30° C. When coupled with the cooling effect of the gas expansion as it passes the valve member 6 this can lead to temperatures as low as −60° or −70° C. within the chamber 14. At such low temperatures available diaphragm materials may stiffen to the extent that reliable operation of the valve cannot be maintained. Bearing in mind that flexure of the illustrated diaphragm 20 occurs only at its peripheral region it is the temperature of that region which is critical in this respect. As that region is also unreinforced by the plate 23 it is necessary to ensure that it cannot be damaged by any objects or material entering the valve housing through the ventilation slots 27. In view of both of these factors the illustrated arrangement has been adopted in which the slots 27 in the housing member 22 are located towards its periphery and an annular baffle 50 is formed on the inside of member 22 to protect the diaphragm 20 from contact through those slots and to deflect ambient air (which is effectively pumped in and out of the housing member 22 as the diaphragm flexes with each breathing cycle) to pass over the peripheral region of the diaphragm. Even at an ambient temperature of −30° C. this air may be sufficiently "warmer" than the expanding gas inside the valve to keep the periphery of the diaphragm sufficiently flexible.

I claim:

1. A gas flow control valve comprising: an inlet chamber and an outlet chamber; a main valve member for controlling the flow of a pressurised gas from the inlet chamber to the outlet chamber; and a flexible pressure-responsive member sensitive to the gas pressure within the outlet chamber for controlling the movement of the valve member; the valve member being an axially-slidable tube opening coaxially at its opposite ends, one said end of which extends into the inlet chamber, the other said end of which leads to the outlet chamber, and the interior of which defines a flow path to lead gas from the inlet chamber to the outlet chamber; a valve seat facing the valve member in the inlet chamber such that the spacing of the valve member from said seat controls the rate of gas flow through the valve member from the inlet chamber to the outlet chamber and contact of the valve member with said seat shuts off such flow; spring means acting upon the valve member to bias the same away from said seat; the pressure-responsive member being arranged to flex in one sense in response to reduction of gas pressure in said outlet chamber and to flex in the opposite sense in response to increase of gas pressure in said outlet chamber, the axis of flexure of the pressure-responsive member being inclined to the axis of the valve member; and mechanical linkage means being provided to link the pressure-responsive member to the valve member, the pressure-responsive member being connected to transmit movement to said linkage means in said opposite sense of its flexure and the linkage means being connected to transmit movement to the valve member in the closing direction thereof; whereby reduction of gas pressure within the outlet chamber permits the valve member to move away from said seat under the bias of said spring means while increase of gas pressure within the outlet chamber causes the pressure-responsive member to move the mechanical linkage means to move the valve member towards said seat against the bias of said spring means.

2. A valve according to claim 1 wherein said spring means comprises a tension spring linked coaxially between said other end of the valve member and a fixed part of the valve structure.

3. A valve according to claim 1 wherein said spring means constitutes the sole spring means acting upon said valve member, pressure-responsive member or mechanical linkage means, in normal operation of the valve.

4. A valve according to claim 1 wherein said pressure-responsive member comprises a flexible diaphragm bounding a portion of the outlet chamber and adapted to flex inwardly and outwardly of said chamber in response to reduction and increase of gas pressure within said chamber respectively; and said mechanical linkage means comprises a lever linked at one end to said diaphragm, pivoted at the other end to a fixed part of the valve structure, and linked at an intermediate position to the valve member, whereby to push the valve member towards said seat in response to outward flexure of said diaphragm.

5. A valve according to claim 1 wherein the pressure-responsive member comprises a diaphragm having a rigid central portion and a flexible peripheral portion and is held by its periphery in the valve structure such as to be exposed on one side to the gas pressure within said outlet chamber and on the opposite side to ambient pressure; the valve structure on said opposite side of the diaphragm being in the form of a housing having a plurality of openings spaced around the axis of the diaphragm to provide communication between the external atmosphere and the interior of the housing; and baffle means being provided inside the housing in association with said openings to protect the diaphragm from damage and to deflect incoming atmospheric air to flow over the peripheral portion thereof.

6. A valve according to claim 1 further including bypass valve means comprising: a bypass chamber on the opposite side of said valve seat to the main valve member; at least one inlet port opening from the inlet chamber to said bypass chamber; an outlet port opening from said bypass chamber through said valve seat at a position to communicate with the interior of the main valve member while the latter is seated; and a bypass valve member in said bypass chamber which normally isolates said outlet port from said inlet port but which can be displaced to permit gas to flow from the inlet chamber to the interior of the main valve member via said bypass chamber.

7. A valve according to claim 6 comprising manually-operable control means for displacing said bypass valve member.

8. A valve according to claim 6 wherein said bypass valve member is in the form of a spring-biased piston which is adapted to be displaced by gas pressure communicated through said inlet port if an abnormally high pressure pertains in the inlet chamber while the main valve member is seated.

9. A valve according to claim 1 comprising a detent member linked to the valve member and a manually-operable control member by which the detent member can be actuated to a detent position in which position the valve member is maintained in contact with the valve seat but from which position the detent member can be released by flexure of the pressure-responsive member to a predetermined extent in said one sense.

10. A valve according to claim 9 wherein the detent member is disposed within the outlet chamber and has a hook-like portion adapted to engage a retaining formation to maintain the detent member in the detent position; the pressure-responsive member comprises a flexible diaphragm bounding a portion of the outlet chamber and adapted to flex inwardly and outwardly of said chamber in response to reduction and increase of gas pressure within said chamber respectively; and said diaphragm is adapted to abut said hook-like portion to release the detent member from its detent position when flexed inwardly to a predetermined extent.

11. A valve according to claim 9 having a gas outlet portion configured as a tubular bayonet fitting; in combination with a device having a gas inlet fitting to receive said outlet portion; the valve having a spring-biased retainer borne radially in association with said bayonet fitting to retain that fitting in a specified rotary position with respect to said inlet fitting when inserted therein; said retainer also constituting said manually-operable control member.

12. A valve according to claim 9 wherein the detent member is linked between the valve member and said spring means; and comprising second spring means linked between said detent member and vale member; the detent member being adapted to remove the bias of the first-mentioned spring means from the valve member and to apply the bias of said second spring means to the valve member to maintain the valve member in contact with the valve seat, when in said detent position.

13. A gas flow control valve comprising: an inlet chamber and an outlet chamber; an axially-slidable main valve member of tubular form, one end of which extends into the inlet chamber, the other end of which leads to the outlet chamber, and the interior of which defines a flow path to lead gas from the inlet chamber to the outlet chamber; a valve seat facing said valve member in the inlet chamber such that the spacing of the valve member from the seat controls the rate of gas flow through the valve member from the inlet chamber to the outlet chamber and contact of the valve member with the seat shuts off such flow; a bypass chamber on the opposite side of said seat to the main valve member; at least one inlet port opening from the inlet chamber to said bypass chamber; an outlet port opening from said bypass chamber through said valve seat at a position to communicate with the interior of the main valve member while the latter is seated; and a bypass valve member in said bypass chamber which normally isolates said outlet port from said inlet port but which can be displaced to permit gas to flow from the inlet chamber to the interior of the main valve member via said bypass chamber.

14. A valve according to claim 13 comprising bypass spring means normally biasing said bypass valve member to isolate said outlet port from said inlet port and manually-operable control means for displacing said bypass valve member at will; and wherein said bypass valve member is permitted to be displaced by gas pressure communicated through said inlet port against the bias of the bypass spring means if an abnormally high pressure pertains in the inlet chamber, irrespective of the operation of said manually-operable control means.

15. A gas flow control valve comprising: an inlet chamber and an outlet chamber; a movable valve member for controlling the flow of pressurised gas from the inlet chamber to the outlet chamber; a flexible pressure-responsive member sensitive to the gas pressure within the outlet chamber for controlling the movement of the valve member whereby normally to maintain a specified super-ambient pressure within the outlet chamber; a detent member linked to the valve member and a manually-operable control member by which the detent member can be actuated to a detent position in which position the valve member is maintained closed but from which position the detent member can be released by flexure of the pressure-responsive member in response to a predetermined sub-ambient pressure within the outlet chamber; a gas outlet portion of the valve being configured as a tubular bayonet fitting; in combination with a device having a gas inlet fitting to receive said outlet portion; the valve having a spring-biased retainer borne radially in association with said bayonet fitting to retain that fitting in a specified rotary position with respect to said inlet fitting when inserted therein; said retainer also constituting said manually-operable control member.

* * * * *